US005479852A

United States Patent [19]

Lloyd

[11] Patent Number: 5,479,852

[45] Date of Patent: Jan. 2, 1996

[54] TABLE HEIGHT ADJUSTABLE DEVICE

[76] Inventor: John T. Lloyd, 80926 Turkey Run Rd., Creswell, Oreg. 97426

[21] Appl. No.: 71,296

[22] Filed: Jun. 2, 1993

[51] Int. Cl.[6] ..... A47B 9/00

[52] U.S. Cl. ..... 108/144; 108/146

[58] Field of Search ..... 108/146, 144, 108/148, 110, 106, 116, 115; 248/423, 188.1

[56] References Cited

U.S. PATENT DOCUMENTS

| | | | |
|---|---|---|---|
| 806,485 | 12/1905 | Parker | 108/146 X |
| 848,435 | 3/1907 | Brooks | 108/146 X |
| 872,498 | 12/1907 | Cleveland | 108/146 |
| 1,838,352 | 12/1931 | Anderson | 108/146 |
| 3,357,729 | 12/1967 | Krueger . | |
| 3,410,232 | 11/1968 | Krueger | 108/146 |
| 4,333,638 | 6/1982 | Gillotti . | |
| 4,690,417 | 9/1987 | Betts et al. | 108/146 X |
| 4,927,128 | 5/1990 | O'Brian . | |
| 5,285,733 | 2/1994 | Waibel | 108/144 |
| 5,335,676 | 8/1994 | O'Brien . | |

FOREIGN PATENT DOCUMENTS

| | | | |
|---|---|---|---|
| 2646103 | 4/1978 | Germany | 108/146 |
| 1157195 | 7/1969 | United Kingdom | 108/144 |

*Primary Examiner*—Jose V. Chen

*Attorney, Agent, or Firm*—Kolisch, Hartwell, Dickinson, McCormack & Heuser

[57] ABSTRACT

A table with extendable legs includes a table top and a plurality of legs extending vertically downward from the table top. Each leg is variably juxtaposed with an extension member along a tapered tongue and groove interface. Each leg and extension member pair is bound together by a yoke. Each yoke has a pivotal cam lever which is rotatable with over center action between a locked position and an unlocked position, so that a pin-to-hole engagement is established between the leg and extension member by urging the lever from its unlocked position to its locked position.

15 Claims, 2 Drawing Sheets

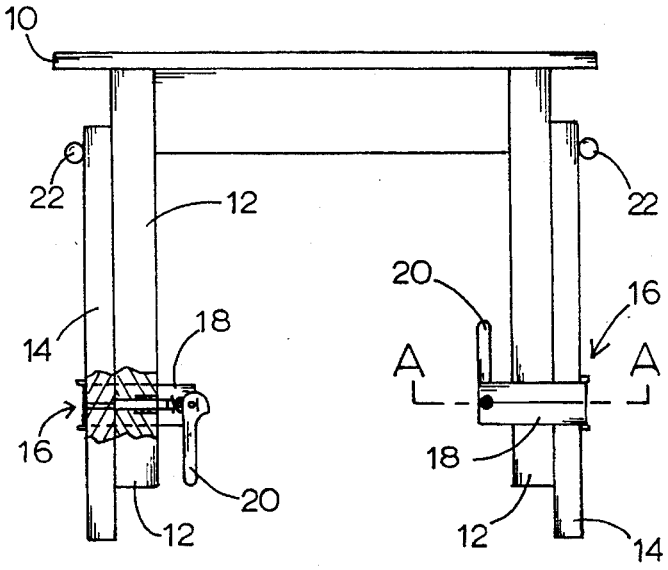
FIG.1
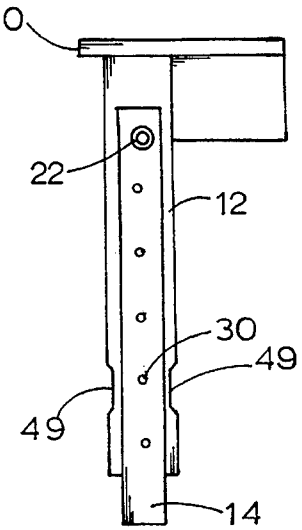
FIG.4
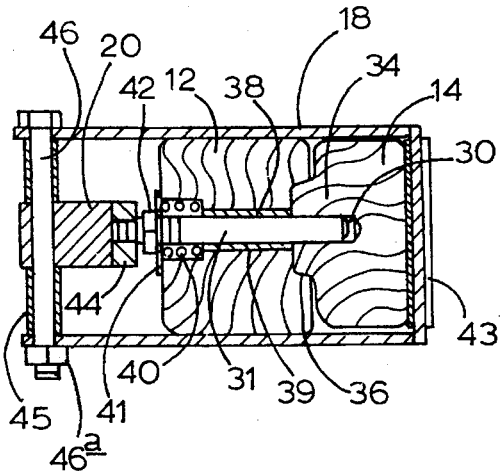
FIG.2 (SECTION A-A)
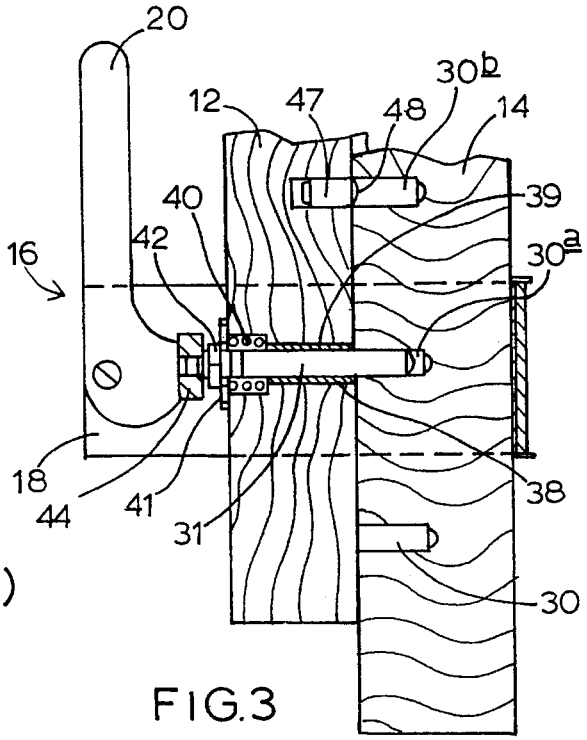
FIG.3

TABLE HEIGHT ADJUSTABLE DEVICE

FIELD OF THE INVENTION

The invention relates to height adjustable tables. In particular, the invention involves a releasable clamp for binding a table leg and extension member and allowing easy adjustment of the table's height.

BACKGROUND OF THE INVENTION

It is often desirable to be able to alter the height of a support surface such as a table. It is especially important to be able to adjust the height of a massage table because if the table is too low the massage technician's back will be strained. However, if the table is too high the massage technician's applicable strength and range of movement will be restricted.

Accordingly, it is a standard feature on most massage tables to provide a height adjustment feature consisting of table legs with adjustable extension members. The leg and extension member are typically aligned in a parallel overlapping relationship along a tongue and groove interface. A series of holes are provided in either the leg or the extension member and a nut and bolt is used to lock the leg and extension member at the appropriate height.

A principle problem with standard height adjustable massage tables is that the required procedure for changing the height of the table is time consuming and cumbersome. Nuts and/or bolts on each table leg must be removed, repositioned into another hole and refastened. In the process of removing the bolt from the leg and extension member the two pieces, i.e., the leg and extension member, are susceptible to being completely separated. Further, there is no mechanism to assist with alignment of the holes after moving the extension member to its new position.

Others have proposed devices for simplifying table height adjustment. For example, U.S. Pat. No. 806,485, issued to Parker in 1905, discloses a height adjustable table in which a table leg and extension member are moveable relative to each other. The leg and extension member are bound by two yokes. The upper most yoke has a lever for allowing release of the yoke so that the locking serrations between the leg and extension member can be disengaged, allowing the height of the table to be altered. However, there are several notable problems with Parker's table. First, the serrations between the leg and extension member make it difficult to adjust or slide the extension member relative to the leg, particularly when lowering the height of the table. Second, Parker's mechanism requires two yokes to keep the leg and extension member parallel. A single yoke binding mechanism would be easier to manufacture and use.

Accordingly, it is an object of the present invention to produce a height adjustable table with a quick release clamp for easy and rapid height adjustment.

Another object is to produce a height adjustable table which only requires a single clamp per leg.

Another object is to provide a height adjustable table which allows easy relative movement between the leg and extension member when the clamp is in the unlocked position.

Another object is to provide a height adjustable table which allows adjustment between a leg and extension member without completely separating the two pieces.

Another object is to provide a height adjustment device which is suitable for use in a collapsible portable massage table for easy transfer or storage.

SUMMARY OF THE INVENTION

The above stated objects and other important objectives are accomplished by the present invention which includes a table top and a plurality of legs connected to the table top and extending vertically downward. A plurality of extension members are parallel and variably juxtaposed along tapered tongue and groove interfaces with the legs. Each leg and extension member pair are bound by a yoke. A cam lever is pivotally mounted on the yoke and rotatable with over center action between a locked position and an unlocked position, so that a pin-to-hole engagement is established between the leg and extension member by urging the lever from an unlocked position to a locked position.

Two embodiments of the invention are disclosed. In a first embodiment, a series of holes are provided on an inner side of the extension member and the clamp is attached to the leg. Alternatively, the clamp may be attached to the extension member and a series of holes may be provided on an inner side of the leg. A pin is connected to a corresponding lever mounted on the leg. The pin is retractable in response to lever movement, so that the pin protrudes from the leg when the lever is in the locked position and retracts into the leg when the lever is moved to the unlocked position. In a preferred embodiment, a detent device is seated in the leg above the pin for assisting the user in properly aligning the holes in the leg and extension member when the height of the table is being adjusted.

In a second embodiment of the invention, at least one pin protrudes from the leg by a fixed distance. The circumference of the yoke is large enough so that when the lever is in the unlocked position the pin can be completely removed from the hole allowing the extension member to be moved relative to the leg. A spring is used to maximumly extend the yoke to facilitate adjustment.

BRIEF DESCRIPTION OF THE FIGURES

FIG. 1 is an end view of a height adjustable table with a partial cutaway illustrating the clamp structure in a first embodiment of the present invention.

FIG. 2 is an enlarged sectional bottom view at cutting plane A—A in FIG. 1.

FIG. 3 is an enlarged sectional side view of the table leg and extension member in the area of the clamp structure in the first embodiment of the present invention.

FIG. 4 is a partial side view of the table showing the leg and extension member without the clamp structure in the first embodiment of the present invention.

DETAILED DESCRIPTION OF THE PREFERRED EMBODIMENTS

Figure 5:
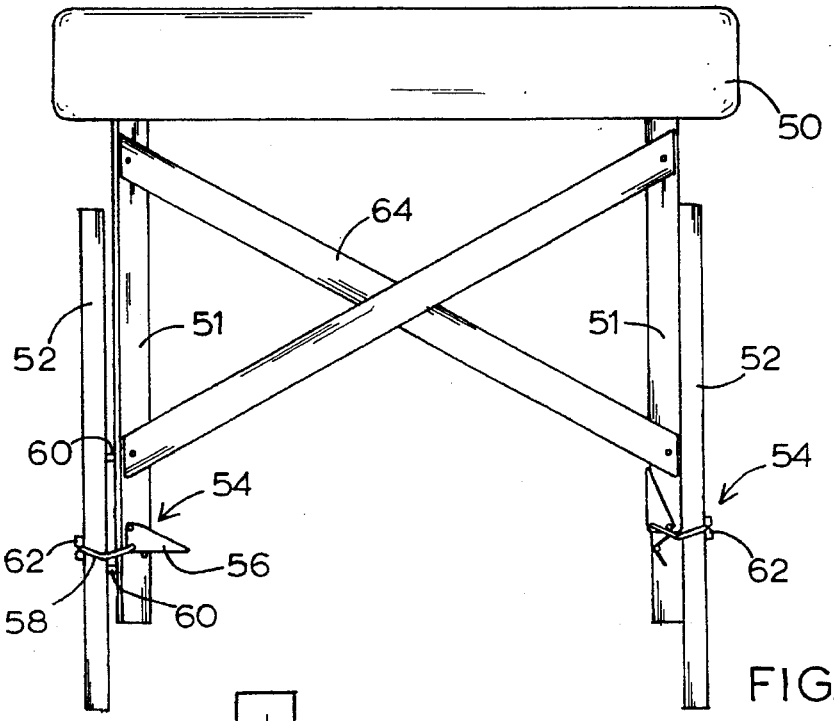
FIG. 5 is an end view of a portable massage table in a second embodiment of the present invention.

The purpose of the invention is to provide a quick and secure means of adjusting the height of a table top relative to the floor. The invention involves the use of a clamp which binds a table leg and extension member and is easily manipulated between locked and unlocked positions.

FIGS. 1–4 show a first embodiment of the present invention in which a table top 10 is supported by table legs 12. As shown in FIG. 1, each table leg 12 is juxtaposed with a leg extension member 14. The degree of overlap between the leg 12 and extension member 14 is variable for the purpose of raising or lowering the table top 10. A clamp structure 16 is used to hold table leg 12 and extension member 14 together. Clamp structure 16 includes a yoke 18 or strap which is attached to leg 12 and binds leg 12 to extension member 14. Cam lever 20 is moveable with over center action between a locked position and an unlocked position. For purposes of describing and claiming the present invention, "cam lever" is defined as a manipulable projection having a shape and pivotal axis such that rotation of the projection from unlocked to locked positions causes tightening of an associated yoke. Handle 22 is provided near the top of each extension member 14 for facilitating movement of extension member 14 when table top 10 is being raised or lowered.

FIG. 2 is an enlarged sectional view showing the internal details of clamp structure 16. One of a plurality of holes 30 in extension member 14 is dimensioned to receive a retractable pin 31 which alternately protrudes and retracts in response to movement of cam lever 20 between locked and unlocked positions respectively.

An important feature of the present invention is the tongue and groove relationship between the leg 12 and the extension member 14. As shown in FIG. 2, tapered tongue portion 34 is provided on extension member 14. Corresponding groove 36 is provided in leg 12. The fit of the tongue and groove is such that when the leg and extension member are clamped together relative movement between the leg and extension member is prevented in all except the vertical direction. Movement in the vertical direction is prevented by locking pin 31 when lever 20 is in the locked position. It is important that groove 34 be tapered so that the two pieces fit smoothly and snugly together when clamped. The tongue and groove relationship between the leg 12 and extension member 14, in combination with the clamp structure 16, securely maintains a parallel relationship between the leg and extension member without the need for additional clamps or points of attachment. The tongue and groove feature also allows easy sliding of the extension member relative to the leg when adjusting the height of the table.

Bushing 38 lines the interior of hole 39 in leg 12. Bushing 38 is made of a low friction material which allows the pin 31 to slide easily in the hole of the leg. Spring 40 is also seated within leg 12 around pin 31 for urging the pin out of hole 30 in extension member 14 when cam lever 20 is moved to the unlocked position. Adjustable self-locking nut 42 is interposed between cam follower 44 and spring 40. The clamping force of yoke 18 can be varied by adjusting nut 42. Cam lever 20 is pivotally mounted on yoke 18 by bolt 46 so that it is free to rotate with over center action between locked and unlocked positions.

FIG. 3 shows clamp structure 16 in the locked position, and illustrates another feature of the first embodiment which assists the user in properly aligning pin 31 in hole **30*a*. Detent device 47 is a bullet catch, i.e., captivated spring loaded plunger, which is seated in a hole in the leg 12 above clamp structure 16. Spring biased rounded surface 48 is urged into hole 30*b* when pin 31 is properly aligned with hole 30*a***. A person who is adjusting the table height feels the bullet catch when the leg and extension member are properly aligned.

As shown in FIG. 4, a vertical array of holes 30 are provided in extension member 14 for receiving pin 31. Handle 22 is provided near the top of extension member 14. Notches 49 are provided in the sides of leg 12 for holding yoke 18 in the vertical direction, while allowing yoke 18 to move relative to leg 12 in the horizontal direction.

In operation, when cam lever 20 is in the locked position, as shown in FIG. 3, it presses against cam follower 44 which acts in turn on locking pin 31, self-locking nut 42, flat washer 41 and leg 12. The reaction to this pressure is transmitted from cam lever 20 to lever pivot bolt 46, to yoke 18 which is free to slide in notches 49 in leg 12, to yoke scuff guard 43 and to extension member 14. Thus, a clamping force is provided holding leg 12 and extension member 14 together with the tongue and groove portions securely mating as described above. In addition to providing clamping force cam lever 20 forces locking pin 31 to protrude from leg 12 into one of the height adjustment holes 30 in extension member 14, thus holding extension member 14 in the desired position.

When cam lever 20 is moved to the unlocked position, as shown in FIG. 1, spring 40 acting against flat washer 41 moves locking pin 31 out of height adjustment hole 30 in extension member 14. This also relieves the clamping force on yoke 18 and allows extension member 14 to slide vertically along leg 12 with the tongue and groove portions remaining engaged.

The spacing of bullet catch 47 is such that a detent position is provided in each position that a height adjustment hole 30 is aligned with locking pin 31. The spring in the bullet catch 47 is easily overcome by pulling up or down on extension member 14, thus making it easy to align the desired height adjustment hole 30 with locking pin 31.

Bushing 38 is pressed into leg 12 and is sized so that it provides accurate location and smooth movement to locking pin 31 during cam lever manipulation. Tubular spacers 45 locate cam lever 20 between the yoke arms as required to align with cam follower 44. Self-locking nut **46*a* holds lever pivot bolt 46 in place. Scuff guard 43 is made of smooth low friction material and allows extension member 14 to be moved relative to yoke 18 more easily and without marring extension member 14**.

FIGS. 5–9 illustrate a second embodiment of the present invention. The second embodiment of the invention is similar to the first embodiment with the additional objective that the mechanism be useable on the legs of a portable table taking up a minimum amount of space so that the legs may be folded up inside the table top.

Figure 7:
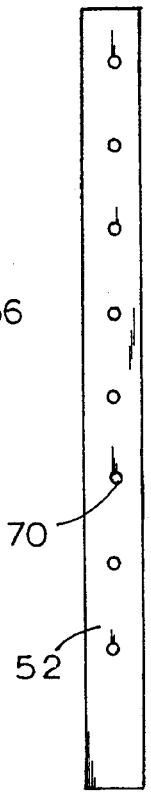
FIG. 7 is a side view of the leg extension member in the second embodiment of the present invention.

Table top 50 is supported by table legs 51 and corresponding extension members 52. The legs and extension members are bound together by clamp structures 54, each of which includes cam lever 56 attached to leg 51. A yoke, for example wire bale 58 is attached to cam lever 56. Cam lever 56 is pivotally mounted on leg 51 so that it is rotatable with over center action between a locked position and an unlocked position. Two pins 60 extend out from leg 51 by a fixed distance, and are dimensioned and spaced so as to fit within holes provided on an inner side of extension member 52, as shown in FIG. 7. The back portion of bale 58 is provided with bale guide 62.

FIG. 5 also illustrates cross supports 64 which are employed to stabilize the vertical orientation of legs 51.

Figure 6:
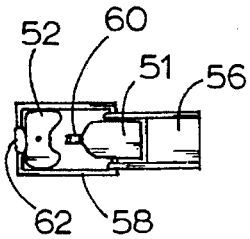
FIG. 6 is a bottom view of the left leg assembly in the second embodiment of the present invention.

It can be seen in FIG. 6 that leg 51 and extension member 52 fit along a tongue and groove interface, similar to the first embodiment described above.

FIG. 7 shows a vertical array of holes 70 provided on the inner side of extension member 52 for receiving pins 60.

Figure 8:
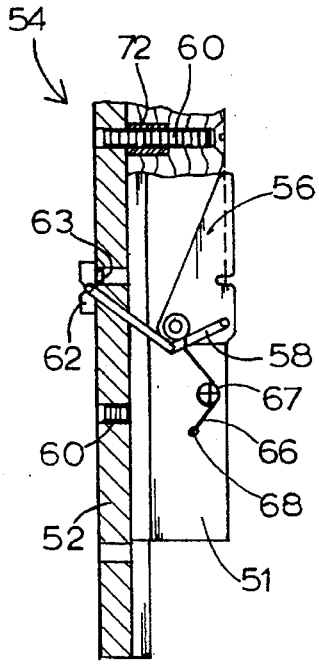
FIG. 8 is an enlarged end view of the clamp structure in the locked position in the second embodiment of the present invention.
Figure 9:
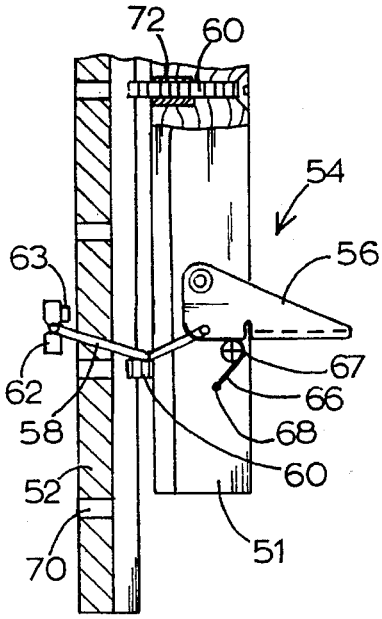
FIG. 9 is an enlarged end view of the clamp structure in the unlocked position in the second embodiment of the present invention.

FIGS. 8 and 9 are exploded partial sectional views of clamp structure 54 in the locked position (FIG. 8) and in the unlocked position (FIG. 9). Bale guide 62 has a peg 63 dimensioned to be received in one of the holes 70 when cam lever 56 is in the closed position.

Bale 58 has hooks on each end that hook through holes in cam lever 56. The portion of bale 58 protruding through cam lever 56 is swaged to prevent bale 58 from coming unhooked, as shown in FIG. 6. Torsion spring 66 is screwed to the leg through its coils by screw 67. One end of torsion spring 66 protrudes into hole 68 in leg 51. The other end of torsion spring 66 hooks over bale 58, as shown in FIG. 8.

As cam lever 66 is rotated it bares against torsion spring 66 causing the arm hooked over bale 58 to rotate about screw 67. When cam lever 66 is in the unlocked position, as shown in FIG. 9, torsion spring 66 causes bale 58 to remain in position with bale guide 62 furthest away from leg 51. This allows extension member 52 to be separated from leg 51 and repositioned to the desired height adjustment holes 70 over the two locking studs 60. When cam lever 56 is rotated to the locked position, as shown in FIG. 8, torsion spring 66 follows it and moves bale 58 upward such that protrusion 63 on bale guide 62 lands in a height adjustment hole. This allows the over center action of cam lever 56 to apply force to bale 58 which has a bend in it to allow a spring force to be transmitted to leg extension 52, thereby clamping it to the leg. The spring action of bale 58 eliminates the need for a clamp force adjustment mechanism. Locking studs 60 are held securely in leg 51 by threaded inserts 72 which are screwed into holes in leg 51.

Although preferred embodiments of the invention have been described in detail above, the claimed invention is intended to cover other variations and modifications within the spirit and scope of the invention as claimed below.

I claim:

1. A table comprising:

a table top;

a plurality of leg assemblies, each leg assembly including a leg member connected to the table top and extending vertically downward;

each leg assembly further including an extension member parallel to the leg member in the assembly and variably juxtaposed to the leg member, the leg assembly further including a tapered tongue extending along one of the members in the assembly and an elongate groove extending along the other member in the assembly and the tongue fitting within the groove;

each leg assembly further including a yoke, the leg member in the assembly being bound to the extension member by the yoke; and each assembly further including a cam lever, each lever being pivotally connected to the yoke in the leg assembly and rotatable between a locked position and an unlocked position, each leg assembly including a series of holes extending along one of the members in the assembly and at least one pin projecting from the other member in the assembly, the pin being registrable with selected ones of said holes when the cam lever is rotated to the locked position.

2. The table of claim 1 wherein each extension member has a vertical array of holes on an inner side and each leg has at least one pin positioned to engage one of the holes in the corresponding extension member when the lever is in its locked position, so that the height of the table can be adjusted by moving the lever to its unlocked position, altering the length of an overlap distance between the leg and extension member, and engaging the pin with another hole by urging the lever back to its locked position.

3. The table of claim 2 wherein the pin protrudes from the leg by a fixed distance, and the yoke is large enough so that when the lever is in the unlocked position the pin can be completely removed from the hole, allowing the length of the overlap distance between the leg and the extension member to be varied before reengaging the pin with another hole by urging the lever back to the locked position.

4. The table of claim 3 wherein each leg has at least two pins spaced apart by a distance allowing both pins to be simultaneously engaged with two of the holes in the extension member when the lever is in the locked position.

5. The table of claim 4 further comprising:

a plurality of yoke guides, each yoke guide having a protrusion and being attached to one of the yokes, wherein each extension member has a series of holes on an outer side for receiving the yoke guide protrusion when the lever is in the locked position; and a plurality of springs, each spring being anchored to one of the legs and urged upon the yoke so as to maximize the distance between the yoke guide and the leg when the lever is in the unlocked position and so that the yoke guide protrusion engages one of the holes on the outer side of the extension member when the lever is in the locked position.

6. The table of claim 5 wherein the holes on the inner side and outer side of each extension member are the same.

7. The table of claim 2 wherein each pin is connected to the corresponding lever and retractable in response to lever movement, so that the pin protrudes from the leg when the lever is in the locked position and retracts into the leg when the lever moves to the unlocked position.

8. The table of claim 7 further comprising a plurality of cam followers, each cam follower being interposed between the lever and the leg.

9. The table of claim 8 further comprising a plurality of adjustable self-locking nuts, each nut being interposed between the cam follower and the leg wherein the clamping force of the yoke can be varied by adjusting the nut.

10. The table of claim 7 further comprising a plurality of detent devices, each leg having a cavity for receiving one of the detent devices, the detent device being seated in the cavity so that a spring biased rounded surface extends into one of the holes on the inner side of the extension member when the pin is aligned with one of the other holes.

11. The table of claim 10 wherein the detent devices are captivated spring loaded plungers.

12. The table of claim 7 further comprising a plurality of knobs, each knob being attached to one of the extension members near a top end of the extension member for handling when adjusting the height of the table.

13. The table of claim 1 wherein the lever is rotatable with over center action between the locked position and the unlocked position.

14. A table with extendable legs, comprising:

a table top having a bottom side;

a plurality of leg assemblies extending vertically downward from the bottom side of the table top, each leg assembly including a leg member coupled to a corresponding extension member along an engaging interface region;

one of the members in each assembly including a tongue structure in the engaging interface region, the other member having a groove complimenting the tongue structure, so that when tile tongue structure and the groove are fully engaged, the leg member and extension member are prevented from lateral skewing movement relative to each other; and one of the members in each assembly including at least one pin protruding toward the other member in the engaging interface region, said other member having holes for receiving said one pin when the tongue structure and groove are fully engaged;

each assembly including a yoke at least partially surrounding the members; and each assembly including a cam lever pivotally connected to the yoke and rotatable between a locked position and an unlocked position, so that when the cam lever is moved from the unlocked position to the locked position, said one pin engages one of said holes and said tongue structure engages said groove thereby preventing all relative movement between the leg member and the extension member.

15. An extendable leg assembly for a table, comprising:

a leg member;

an extension member coupled to the leg member along an engaging interface region;

a tongue structure provided on one of the members in the engaging interface region, the other member having a groove complimenting the tongue structure, so that when the tongue structure and the groove are fully engaged, the leg member and extension member are prevented from lateral skewing movement relative to each other; and at least one pin protruding from one of the members toward the other member in the engaging interface region, said other member having holes for receiving said one pin when the tongue structure and groove are fully engaged;

a yoke at least partially surrounding the members; and a cam lever pivotally connected to the yoke and rotatable between a locked position and an unlocked position, so that when the cam lever is moved from the unlocked position to the locked position, said one pin engages one of said holes and said tongue structure engages said groove thereby preventing all relative movement between the leg member and the extension member.

* * * * *